US005992679A

United States Patent [19]

Porchia et al.

[11] Patent Number: 5,992,679

[45] Date of Patent: Nov. 30, 1999

[54] CONTAINER HAVING A SELECTIVELY DETACHABLE LID INCLUDING AN INTERRUPTED REINFORCING BEAD

[75] Inventors: Jose Porchia, Midland; Jeffey J. Zettle, Bay City, both of Mich.

[73] Assignee: S. C. Johnson Home Storage, Inc., Racine, Wis.

[21] Appl. No.: 09/104,739

[22] Filed: Jun. 25, 1998

[51] Int. Cl.[6] ..... B65D 41/16

[52] U.S. Cl. ..... 220/782; 220/789; 220/791; 220/802; 220/805

[58] Field of Search ..... 220/782, 787, 220/789, 790, 791, 793, 796, 800, 801, 802, 805

[56] References Cited

U.S. PATENT DOCUMENTS

| | | | |
|---|---|---|---|
| 3,529,531 | 9/1970 | Swett | 220/802 |
| 3,719,304 | 3/1973 | Douglas | 220/805 X |
| 3,927,820 | 12/1975 | Wagner et al. | 220/796 |
| 4,293,080 | 10/1981 | Letica . | |
| 4,351,447 | 9/1982 | Graff . | |
| 4,457,447 | 7/1984 | Kirkis . | |
| 4,474,305 | 10/1984 | Marco . | |
| 4,494,674 | 1/1985 | Roof . | |
| 4,555,043 | 11/1985 | Bernhardt . | |
| 4,555,056 | 11/1985 | Bernhardt . | |
| 4,721,210 | 1/1988 | Lawrence et al. . | |
| 4,741,452 | 5/1988 | Holzkopf . | |
| 4,742,934 | 5/1988 | Michaud et al. . | |
| 4,804,092 | 2/1989 | Jones . | |
| 4,809,868 | 3/1989 | Pomroy | 220/805 X |
| 4,819,834 | 4/1989 | Longbottom et al. . | |
| 4,836,407 | 6/1989 | Bruce et al. . | |
| 4,886,184 | 12/1989 | Chamourian . | |
| 4,976,370 | 12/1990 | Cassel . | |
| 5,092,479 | 3/1992 | Wells . | |
| 5,108,768 | 4/1992 | So . | |
| 5,129,517 | 7/1992 | Hustad . | |
| 5,269,430 | 12/1993 | Sclaupitz et al. . | |
| 5,375,719 | 12/1994 | Mittmann et al. . | |
| 5,377,860 | 1/1995 | Littlejohn et al. . | |
| 5,425,467 | 6/1995 | Feer et al. | 220/805 X |
| 5,507,407 | 4/1996 | Feer et al. . | |
| 5,553,701 | 9/1996 | Jarecki et al. . | |
| 5,577,613 | 11/1996 | Laidlaw . | |
| 5,607,709 | 3/1997 | Fritz et al. . | |
| 5,624,051 | 4/1997 | Ahern, Jr. et al. | 220/805 X |

*Primary Examiner*—Stephen K. Cronin

[57] ABSTRACT

A resilient microwavable container including a bowl and a selectively detachable snap on lid. The lid includes a sealing lip including an outwardly extending rigid tab member and a body including a substantially annular reinforcing bead which is interrupted adjacent to the tab member. The combination of the rigid tab member in association with the interrupted annular bead allows for readily removing the lid from the bowl when desired with a low separation force.

15 Claims, 3 Drawing Sheets

CONTAINER HAVING A SELECTIVELY DETACHABLE LID INCLUDING AN INTERRUPTED REINFORCING BEAD

BACKGROUND OF THE INVENTION

1. Technical Field

The present invention generally relates to a container useful for storing and transporting items such as food and, more particularly, to a container including a bowl and selectively detachable lid including an interrupted reinforcing bead to assist in selectively detaching the lid from the bowl.

2. Description of the State of the Art

Containers, particularly those used for heating foodstuffs in a microwave oven generally should be relatively low in cost and easy to utilize. Additionally, such containers should be versatile to use, that is, capable of withstanding drastically different environments such as occurs when transferring the container directly from the refrigerator or freezer to a microwave oven, for example.

With regard to these microwavable containers, a primary focus in the art has been on providing a good seal between the lid and the bowl. However, many of the known sealable microwave containers are unnecessarily complicated with regard to the sealing assembly. For example, U.S. Pat. No. 5,377,860 requires a specifically shaped double seal arrangement along the sealing rim. According to this patent, the base and the lid both require an inwardly disposed tapering frusto-conical seal area and a downwardly and outwardly extending brim with mating undercuts. While a high integrity seal may be accomplished, it is believed that unnecessarily high separation forces are required to detach the lid from the bowl. This, in turn, makes such containers more prone to spills which is highly undesirable.

Heretofore, resilient microwavable containers have generally included a relatively flimsy lid and tab construction (when a tab member is present) which requires higher than necessary separation forces to detach the lid from the bowl. The art has in large part failed to consider how the structure of the lid, taken in conjunction with the sealing assembly, affects the magnitude of the separation forces required to detach the lid from the bowl.

SUMMARY OF THE INVENTION

It is therefore a primary object of the present invention to provide a container including a bowl and a selectively detachable lid including a rigid tab member and reinforcing bead having an interruption occurring in proximity to the tab member which allows for a relatively easy attachment and detachment of the lid.

Yet another object of the present invention is to provide a low cost, high production volume container made from a resilient material.

Still another object of the present invention is to provide a resilient container which is useful in various environments such as refrigerator freezers and microwave ovens.

The foregoing objects are achieved by providing a container including a bowl and a selectively detachable lid made from a resilient polymeric material which are mateable in an interference fit relationship.

The lid portion generally includes a body having a peripheral sealing lip and a relatively rigid tab extending therefrom. Disposed inwardly from the peripheral sealing lip along the body of the lid is a substantially annular reinforcing bead which is interrupted in proximity to the rigid tab member. While the annular reinforcing bead serves to stiffen the body of the lid, the interruption is provided to allow for flexing of the sealing lip and body along the sealing area adjacent the tab member to assist in initially overcoming the interference fit between the bowl and the lid. Once the seal is broken, the overall stiffness of the lid which is enhanced by the bead allows for easy removal from the bowl.

The containers of the present invention can be economically thermo-formed from any one of a number of known thermoplastic resins including but not limited to polyamides, polyacrylics, polyarylates, polycarbonates, polyesters, polyetherimides, polyetherketones, polyolefins, polyphenylenes, polyvinylchlorides, and various styrene and liquid crystal polymers, among others.

The various features, objects and advantages of the present invention should become still more apparent from a review of the following description of the drawings and invention in detail.

DETAILED DESCRIPTION OF THE PREFERRED EMBODIMENTS

Figure 1:
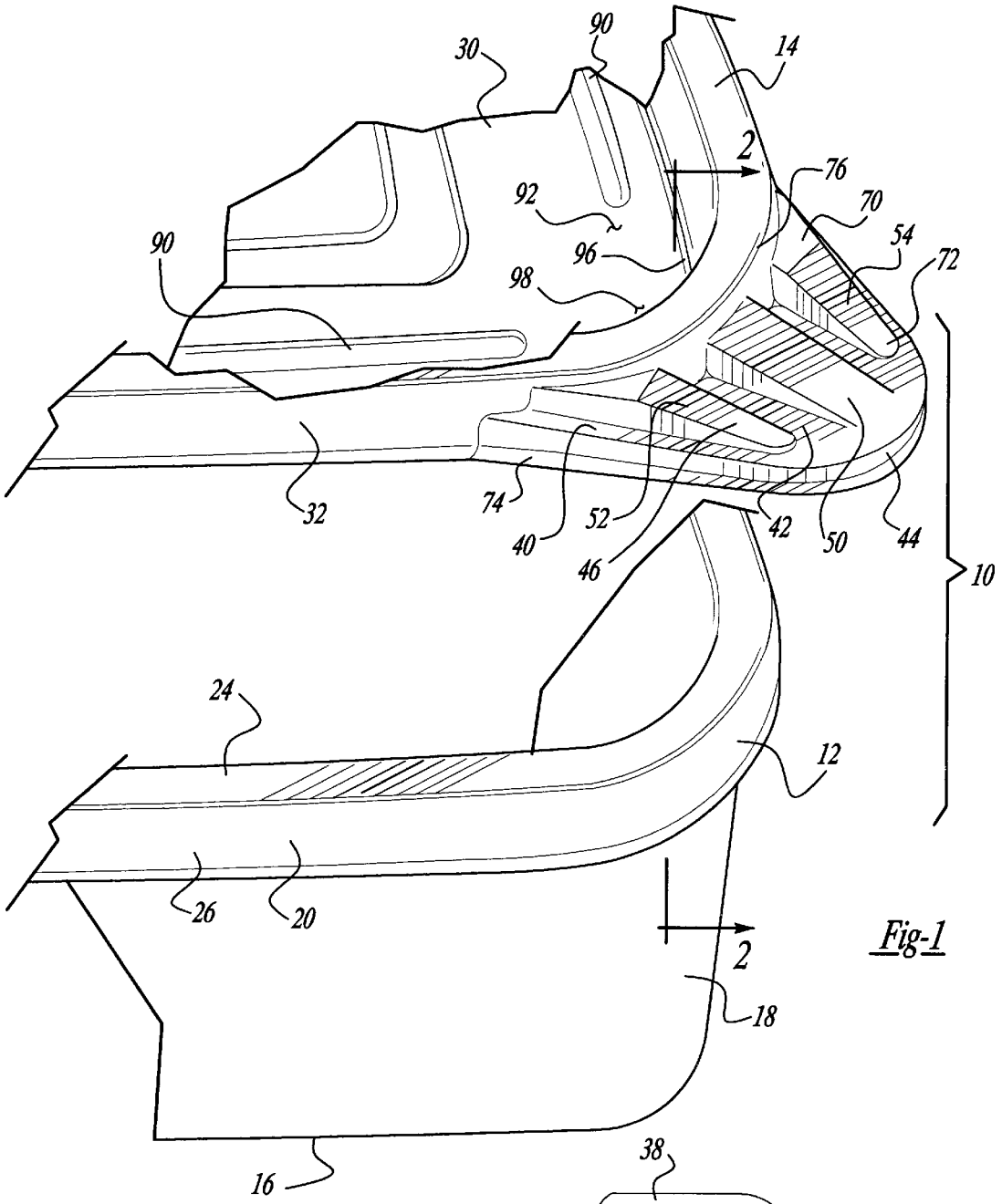
FIG. 1 is an exploded perspective view of a container assembly including a bowl and selectively detachable lid made in accordance with the teachings of the present invention.

Referring generally to FIG. 1, there is shown a container 10 including a bowl 12 and selectively detachable lid 14 formed in accordance with the teachings of the present invention. From the outset, it should be noted that while the container is illustrated generally as being of a rectangular configuration, the container may be of various other configurations such as round, oval or square by way of non-limiting example.

The bowl 12 generally includes a bottom 16 and a continuous side wall 18 extending vertically from the bottom. Integrally connected to the vertically extending sidewall is an L-shaped lip 20 including a first leg 24 which extends outwardly from the sidewall and a second leg 26 which extends downwardly from the first leg. As can be seen more clearly with reference to FIG. 2, the upper portion 22 of the sidewall 18 preferably includes an inwardly extending annular nub 28 which assists in making the sealing engagement between the lid and the bowl as will be described in greater detail below.

The lid 14 generally includes a central disk-shaped body 30 having a peripherally disposed lip 32 which overlays a portion of the lip 20 provided on the bowl 12 upon attachment. The lip 32 generally has an inverted U-shape in cross section including a first leg 34 which extends from the body, a second leg 36 and a web 38 disposed therebetween as shown most clearly in FIG. 2. Thus, upon joining the lid 14 to the bowl 12, the first leg 34 is advanced over the annular nub 28 until the sealing point 5 engages the inner surface of the side wall to provide an interference fit between the lid and bowl. Extending outwardly from the second leg of the lip 32 is a rigid tab member 40 designed to resist bending at the point of attachment to the sealing lip.

Figure 3:
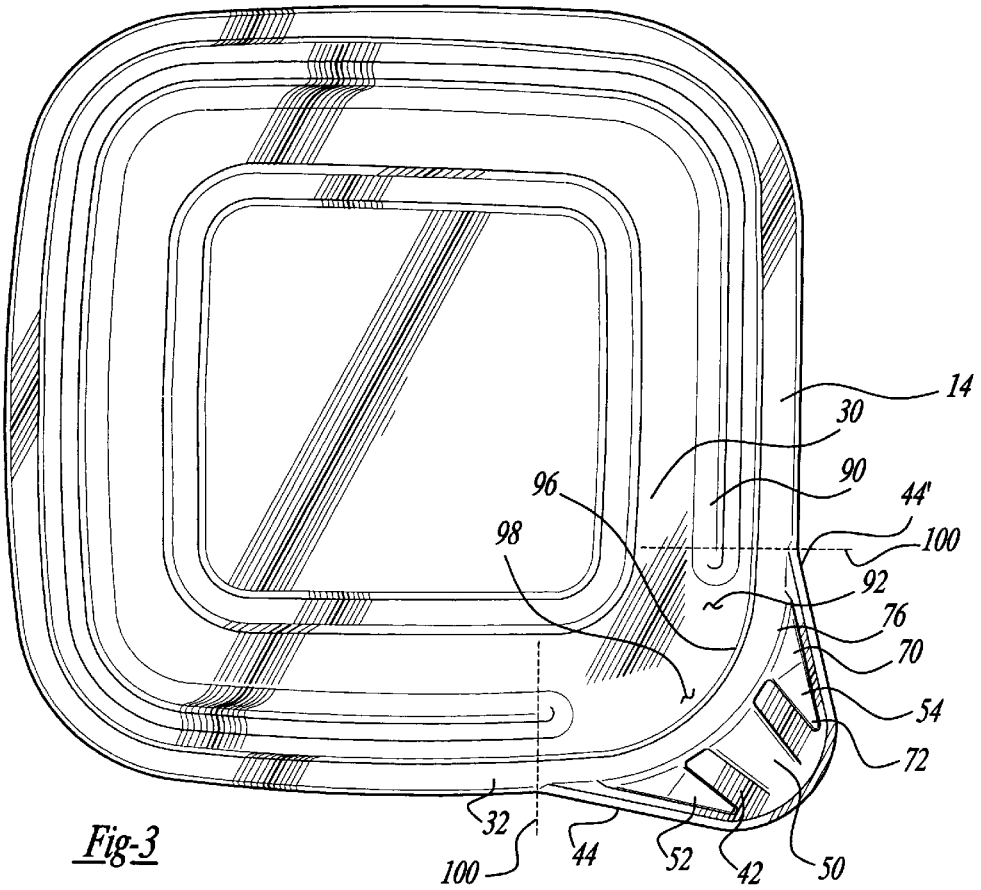
FIG. 3 is a top view of a first embodiment of the lid in accordance with the teachings of the present invention.
Figure 4:
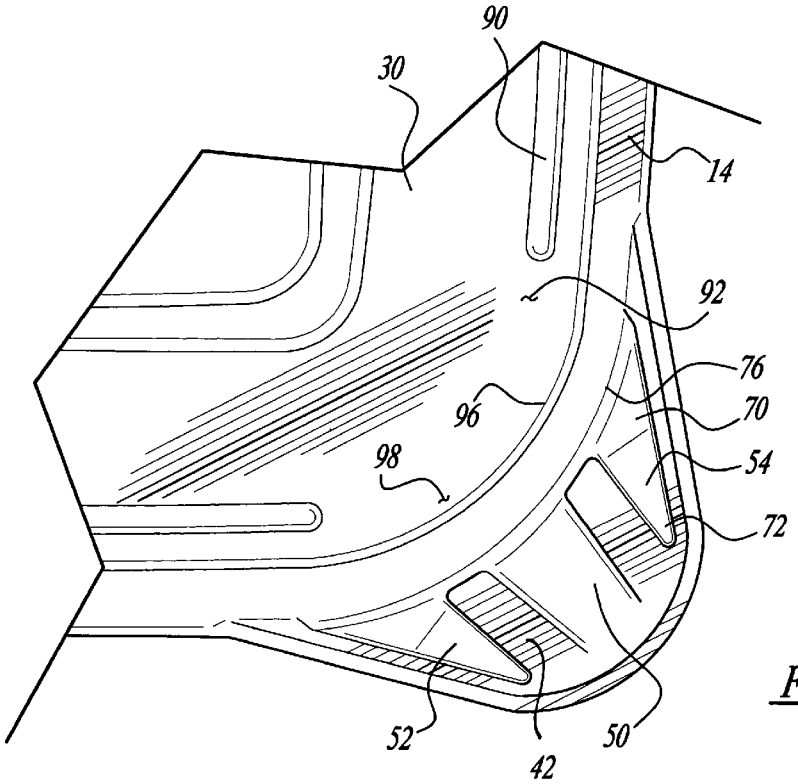
FIG. 4 is a partial top view of a second embodiment of the lid in accordance with the teachings of the present invention.

The lid 14 is also generally provided with a substantially annular reinforcing bead 90 extending upwardly from the body of the lid and spaced inwardly from the lip 32. The reinforcing bead 90 extends continuously around the lid except for an area of interruption 92 occurring along the body adjacent the tab member 40. The annular bead 90 terminates slightly within the outermost points where the peripheral edge 44 of the tab member 40 terminates into sealing lip 32, i.e., within the confines of imaginary lines 100 extending from the diverging edges 44, 44' of the tab member 40 as illustrated in FIG. 3. It should also be noted that the area of interruption can be reduced if desired which in turn slightly increases the removal force necessary to detach the lid from the bowl.

Figure 5:
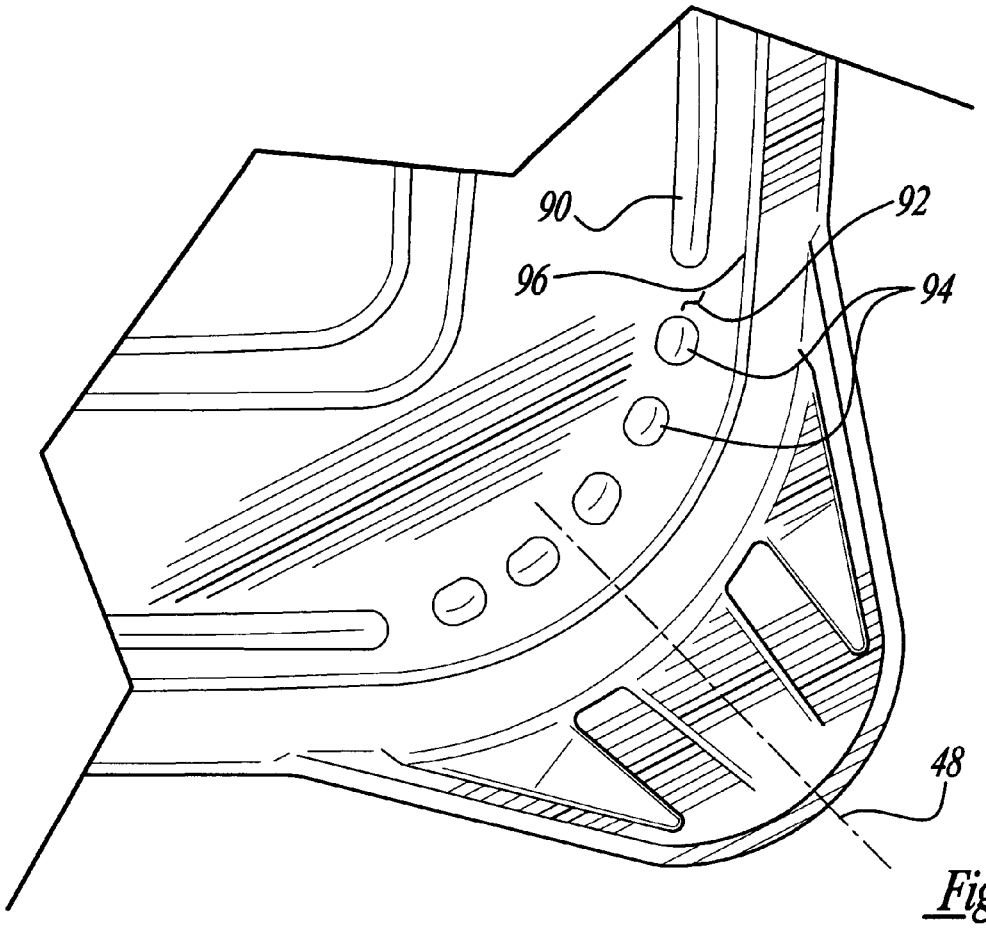
FIG. 5 is a partial top view of the third embodiment of the lid in accordance with the teachings of the present invention.

The interruption may be continuous as shown in the embodiment of FIG. 3 or may include a plurality of spaced apart bead segments 94 as shown in FIG. 5. Preferably, the substantially annular bead 90 is spaced in relatively close proximity to the sealing lip 32. In this regard, the annular bead 90 should be spaced between 0.5 cm and 6.0 cm from the leading edge 96 of the sealing lip 32.

As will be described in greater detail below, it is the combination of the interrupted reinforcing bead 90 and the rigid tab member 40 which serves to reduce the separation force required to overcome the interference fit between the lid and the bowl as compared to other microwavable containers known in the art.

Figure 2:
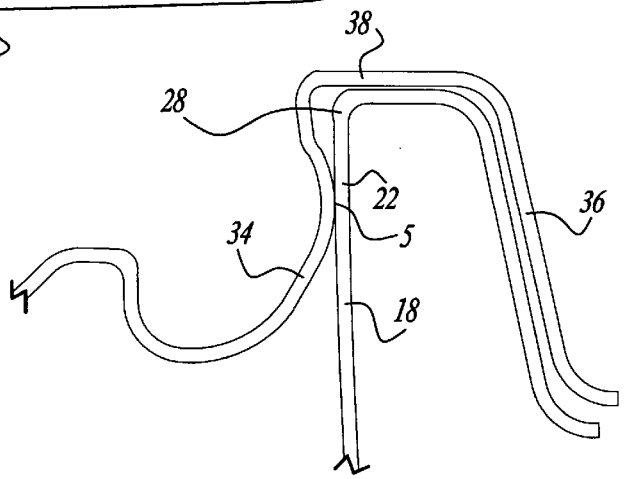
FIG. 2 is a partial sectional view of the container of FIG. 1 taken along lines 2—2.

The rigid tab member 40 which is substantially triangular in shape as shown in FIG. 2 includes a floor 42 and a peripheral edge 44. The floor 42 is provided with a plurality of spaced apart upstanding ribs 46 including a first rib 50 disposed along a longitudinal center line drawn through the tab as designated by reference numeral 48. Disposed on opposite sides of the first rib, are second and third ribs 52 and 54, respectively, which extend angularly away from the longitudinal center line 48. Each of the ribs are defined by rather abrupt edges which further enhance the structural rigidity of the tab member.

The ribs are positioned at specific locations to maximize the tab's rigidity and thereby enhance the transfer of separation forces from the tab member to the sealing region, i.e., enhance the releasability of the lid from the bowl when desired. For example, the first rib 50 includes a first transverse edge relative to the floor which extends at an angle of between about 3° to about 7° from the longitudinal center line and a second transverse edge extending at an angle of between about −3° to about −7° from the longitudinal center line. Thus, the first rib is generally trapezoidal in shape.

The second rib 52 includes a first transverse edge extending at an angle of between about 8° to about 12° from the longitudinal center line 48 and a second transverse edge extending at an angle of between about 20° to about 40° from the longitudinal center line. The third rib 54 which is the mirror image of the above described second rib 52 extends at an angle of between about −8° to about −12° along a first transverse edge and at an angle of between about −20° to about −40° from the longitudinal center line along a second transverse edge. Thus, as shown and described with regard to the preferred angular orientations, the second and third ribs extend angularly away from the longitudinal center line and are substantially triangular in shape.

It should be noted that the negative degree designations (−°) relative to the longitudinal center line are utilized herein for clarity and to emphasize that the second and third ribs are preferably mirror images of each other. As such, one skilled in the art should readily recognize, for example, that −3° is equivalent to 357° and −7° is equivalent to 353° utilizing standard radius expressions.

Each of the upstanding ribs include a first end 70 terminating proximate to the lip 32 and a second end 72 terminating proximate to the peripheral edge 44 of the tab. The upstanding ribs are generally sloped upwardly from the second end to the first end at an average inclination of between about 12° to 18° such that the ribs join the lip 32 near the junction 76 between the web 38 and second leg 36. The peripheral edge of the tab member preferably includes a downturned flange 74 which extends below the floor 42 and thus provides a barrier to prevent a user's thumb or finger from sliding off of the tab member.

To remove the lid 14 from the bowl 12, the user pulls upwardly on the tab member 40. As this is done, the separation forces are transferred from the rigid tab member 40, due to its stiffness, to the sealing lip 32 and body portion 98 which are somewhat flexible due to the area of interruption 92 in the annular bead 90 and the resilient nature of the polymeric material employed. The seal resulting from the interference fit is initially overcome along the tab corner of the container. As the user continues to pull up on the tab member 40, the remainder of the lid detaches easily due to the stiffness provided about the periphery of the lid by the annular bead 90.

Thus, as should be understood upon review of the foregoing, the container of the present invention offers a high quality seal due to the interference fit between the lid and bowl and further allows for easy detachment of the lid when desired.

As noted, while the lid and bowl may be thermo-formed from any one of a number of different polymeric materials, a polypropylene homopolymer optionally including a slip agent is considered to be preferable. By utilizing a polypropylene homopolymer, the lid and bowl can be thermoformed to have an average thicknesses of between about 10 to 50 mils and still offer the necessary structural integrity.

While it will be apparent that the preferred embodiments of the invention disclosed are well calculated to fulfill the objects stated, it will be appreciated that the invention is susceptible to modification, variation and change without departing from the spirit thereof.

What is claimed is:

1. A container including a bowl and a selectively detachable lid, said lid comprising:

a body and a peripheral sealing lip extending from said body along a leading edge thereof;

a rigid tab member extending from said sealing lip along a peripheral edge thereof; and a substantially annular reinforcing bead disposed along said body inwardly from said sealing lip, said reinforcing bead including an area of interruption disposed along said body adjacent said tab member.

2. The lid of claim 1, wherein said reinforcing bead extends upwardly from said body.

3. The lid of claim 1, wherein said area of interruption includes at least one reinforcing bead segment spaced apart from said reinforcing bead.

4. The lid of claim 1, wherein said reinforcing bead is spaced between about 0.5 cm to about 6.0 cm from the leading edge of said peripheral sealing lip.

5. The lid of claim 1, wherein said tab member includes a plurality of spaced apart upstanding ribs.

6. The lid of claim 5, wherein said plurality of spaced apart upstanding ribs includes a first rib disposed along a longitudinal center line and at least one other rib extending angularly away from said longitudinal center line.

7. The lid of claim 5, wherein said upstanding ribs include a first end terminating proximate to said sealing lip and a second end terminating proximate to the peripheral edge of said tab member.

8. The lid of claim 7, wherein said upstanding ribs are sloped upwardly from said second end to said first end.

9. A resilient microwavable container comprising:

a bowl including a bottom, a container side wall extending upwardly from said bottom to define a bowl cavity and a lip extending from said side wall; and a selectively detachable lid including a central generally disk-shaped body having a peripheral sealing lip including an outwardly extending rigid tab member, said body including a substantially annular reinforcing bead disposed inwardly about 0.5 cm to about 6.0 cm from said sealing lip, said annular bead including an interruption disposed along said body adjacent said tab member to thereby assist in removing the lid from the container.

10. The container of claim 9, wherein said reinforcing bead extends upwardly from said body.

11. The container of claim 9, wherein said interruption includes at least one reinforcing bead segment spaced apart from said reinforcing bead.

12. The container of claim 9, wherein said tab member includes a plurality of spaced apart upstanding ribs.

13. The container of claim 12, wherein said plurality of spaced apart upstanding ribs includes a first rib disposed along a longitudinal center line and at least one other rib extending angularly away from said longitudinal center line.

14. The container of claim 12, wherein said upstanding ribs include a first end terminating proximate to said sealing lip and a second end terminating proximate to the peripheral edge of said tab member.

15. The container of claim 14, wherein said upstanding ribs are sloped upwardly from said second end to said first end.

* * * * *

UNITED STATES PATENT AND TRADEMARK OFFICE
CERTIFICATE OF CORRECTION

PATENT NO : 5,992,679

DATED : November 30, 1999

INVENTOR(S) : Jose Porchia and Jeffrey J. Zettle

It is certified that error appears in the above-identified patent and that said Letters Patent are hereby corrected as shown below:

Inventors:

[75] Please delete "Jeffey" J. Zettle and change to --Jeffrey-- J. Zettle

Signed and Sealed this

Twenty-seventh Day of March, 2001

*Attest:*

Nicholas P. Godici

NICHOLAS P. GODICI

*Attesting Officer*

*Acting Director of the United States Patent and Trademark Office*